US005215371A

United States Patent [19]

Pileski

[11] Patent Number: 5,215,371

[45] Date of Patent: Jun. 1, 1993

[54] LAMP HOLDER

[75] Inventor: Michael J. Pileski, Skaneateles, N.Y.

[73] Assignee: Welch Allyn, Inc., Skaneateles Falls, N.Y.

[21] Appl. No.: 781,080

[22] Filed: Oct. 21, 1991

[51] Int. Cl.[5] ..... F21V 21/00

[52] U.S. Cl. ..... 362/306; 362/390

[58] Field of Search ..... 362/306, 390, 433, 440, 362/382, 431

[56] References Cited

U.S. PATENT DOCUMENTS

| | | | |
|---|---|---|---|
| 1,795,696 | 3/1929 | Yaupp . | |
| 1,808,501 | 6/1931 | Lang . | |
| 1,812,476 | 6/1931 | Godley . | |
| 1,910,542 | 11/1933 | Hendee . | |
| 3,065,341 | 11/1962 | Shaver . | |
| 3,529,149 | 9/1970 | Dwyer . | |
| 4,384,319 | 5/1983 | Blaisdell et al. | 362/306 |
| 4,387,417 | 6/1983 | Pleamons et al. | 362/306 |
| 4,388,679 | 6/1983 | Blaisdell et al. | 362/306 |
| 4,430,696 | 2/1984 | Lemcke . | |
| 5,047,900 | 9/1991 | DiRisio | 362/306 |

*Primary Examiner*—Richard R. Cole
*Attorney, Agent, or Firm*—Wall and Roehrig

[57] ABSTRACT

A pair of standoff posts and an endless coil spring form a simple mounting construct for positioning a bulb and reflector assembly in a lamp fixture. The reflector is positioned within the loop of the coil spring and the height of the standoff posts is chosen to locate the spring about the midpoint of the depth of the reflector so that the spring imparts both a centering action on the reflector and a clamping action of the reflector against the lamp fixture. The standoff posts are positioned at opposite ends of an extended diameter of the reflector and with the loop spring form a self-centering and locating mounting for the bulb and reflector assembly on the lamp fixture.

11 Claims, 1 Drawing Sheet

LAMP HOLDER

BACKGROUND OF THE INVENTION

This invention relates to apparatus for mounting a lamp in a fixture, and more particularly to an apparatus for quickly and easily removably mounting a bulb and reflector assembly in a lamp fixture.

For many years lightbulbs have been mounted in various fixtures for illuminating desired objects and frequently have been mounted in reflectors to enhance and direct the light output from the bulb to the desired objective. This has frequently been accomplished by turning a bulb into a socket which is positioned in the fixture. The socket has frequently had a screw thread type of mounting or a bayonet mounting, as has been well known for many years in the flashlight, automotive and other types of applications. For certain applications, the orientation of the bulb in the reflector and lamp fixture have had to be accomplished very precisely to meet the desired specifications from the standpoint of focusing the light energy, control of chromaticity, or other aspects of the illumination. These devices have worked generally quite well for the incandescent type of lightbulb, but as other types of lightbulbs such as metal halide arc discharge lamp bulbs have become available, the conventional threaded socket mounting has not been suitable. Similarly, the two prong plug-in type of fixture has had limited application in the newer technologies.

With many of the newer type bulbs becoming available in the industry, the operating temperature of the bulb has been greatly increased. In those situations where the bulb burns out for some reason in an instrument that must immediately have the bulb replaced, the conventional mounting of the bulb has presented a problem from the standpoint that the lamp had to be allowed to cool before it could be removed and replaced. This has been, in some situations such as medical instruments and the like, an unacceptable risk. Also, with many new lamps resistance to vibration of the mounting has become important.

OBJECTS AND SUMMARY OF THE INVENTION

It is therefore an object of the present invention to provide a mounting for a bulb and reflector assembly that overcomes the limitations of the prior art.

It is another object of the present invention to provide a bulb and reflector assembly mounting apparatus that provides for the quick and easy replacement of the assembly, even when heated to an elevated temperature.

It is another object of the present invention to provide a simplified, economical mounting device for positioning a bulb and reflector assembly in a lamp fixture in a predetermined location and orientation.

It is another object of the present invention to provide a lamp mounting device for positioning and securing a reflector to a lamp fixture.

It is a still further object of the present invention to provide a self-centering vibration resistant mounting for bulbs and reflectors in lamp fixtures.

These and other objects are achieved in one embodiment of the invention by the provision of a pair of standoff posts mounted on the lamp fixture approximately on the opposite ends of a diameter of a hemispherical reflector which carries therein the lightbulb to be positioned in the lamp fixture. A continuous helical coil spring, called a "garder" spring, is fixed about the ends of the standoff posts in a groove formed adjacent the ends thereof. The coil spring forms a pair of resilient arms which partially wrap about the lamp reflector when the lamp reflector is inserted between the parallel spring members and the lamp fixture so as to hold the lamp against the fixture and to center it about a predetermined point between the two standoff posts.

BRIEF DESCRIPTION OF THE DRAWINGS

Further objects of the invention together with additional features and advantages accruing therefrom will become apparent from the following description of a preferred embodiment shown in the accompanying drawings in which.

DETAILED DESCRIPTION OF A PREFERRED EMBODIMENT

Figure 1:
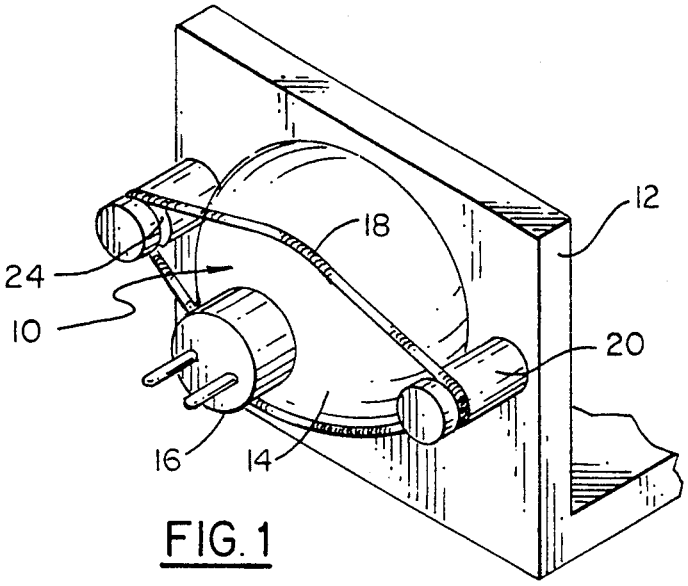
FIG. 1 is a perspective view of a lamp mounted in a fixture according to the present invention.

Referring now to FIG. 1, a lamp and reflector assembly 10 is shown mounted in a fixture 12 according to the present invention. The bulb and reflector assembly 10 includes a generally hemispherical or cup shaped reflector portion 14 and a bulb 16 fixed in the center of the reflector 14. The assembly 10 is held in position on the fixture 12 by a helical coil spring 18 wrapped around vertical standoff posts 20 which have an annular recess 24 adjacent the outboard ends thereof to hold the spring spaced off from the fixture 12. It should be noted the spring 18 is free to slide about the posts 20 within the grooves 24 to ease installation and removal of the reflector assembly 10.

Figure 2:
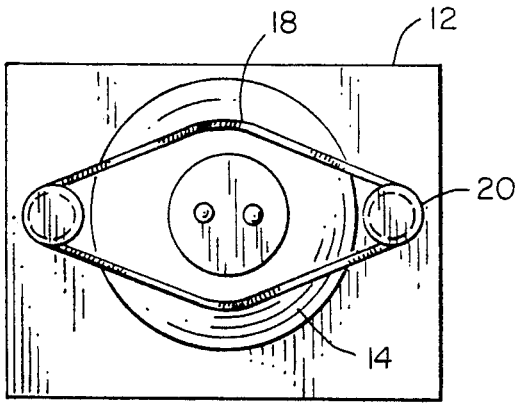
FIG. 2 is a back elevation of the mounting of FIG. 1.
Figure 3:
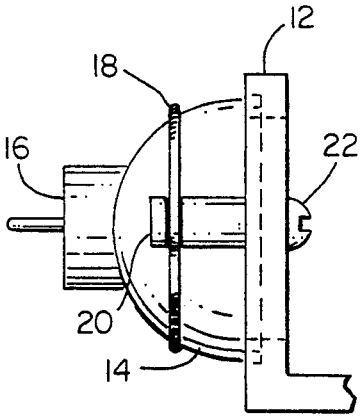
FIG. 3 is a side elevation of the lamp mounting of FIG. 1.

As may be seen in FIG. 3, the standoff posts 20 have an overall length less than the depth of the hemispherical reflector 14 and advantageously have the annular groove for aligning the spring 18 positioned approximately at one-half the depth of the reflector. The posts 20 are fixed to the fixture 12 by a bolt 22 or other suitable fastening means so that the posts can be held in an upright position and will support the spring member 18 when it is engaged about the ends thereof. The posts 20, as can be seen in the drawings, are a small diameter standoff readily available in the industry and form with the spring 18 when the reflector is not in place a pair of parallel arm segments spaced apart approximately the diameter of the bottom of the grooves in the ends of the post. When the bulb and reflector assembly 10 is mounted to the fixture 12, the springs are spread apart, as may be seen in FIG. 2, so as to partially wrap around the outer surface of the reflector 14 along a line located generally from half the depth of the hemispherical reflector to the apex of the reflector. This can be seen also in FIG. 3 and as can be seen from FIGS. 1–3, the spring 18 when in the spread apart condition of FIG. 2, imparts both a lateral and a vertical force to the reflector so as to urge it into intimate contact with the fixture 12 and to also center it about a point midway between the two posts 20.

In normal use, the fixture 12 has a circular opening slightly smaller in diameter than the diameter of the outer edge or lip of the reflector 14 so that light from the bulb 16 positioned in the reflector 14 can be projected therethrough to the object to be illuminated. Not only does the spring provide a quick and easy way to mount the lamp assembly 10 in the fixture 12, but it also will hold the assembly in proper position even under substantial vibration. By staking or welding the posts 20 to the fixture 12, the mounting becomes vibration proof, i.e., there are no threaded parts to be vibrated loose. Also, with only two simple standoff posts and a spring, the mounting becomes very economical to manufacture and use.

Figure 4:
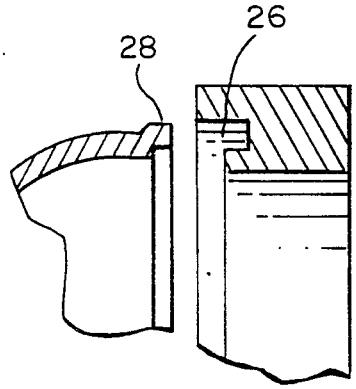
FIG. 4 is a partial sectional view on an enlarged scale showing the groove in the fixture for receiving the flange of the reflector.

Referring now to FIG. 4, in certain applications the fixture 12 is provided with a groove 26 centered about the opening in the fixture 12 through which the light is to be projected. The groove 26 is configured to receive therein the lip 28 of the reflector 14 to help to center and secure the reflector 14 in proper position on the lamp fixture 12. The groove 26 may have a width greater than the thickness of the lip 28 in which case the spring 18 will tend to center the reflector 14 about the axis of the opening in the fixture 12. For those applications requiring precise positioning, such as for illuminating the end of a fiber optic bundle, the groove will be precisely formed with the reflector to insure proper focus on the desired spot.

In use, this spring mounting provides a very simple and easy way to exchange the bulb and reflector assembly 10 by simply sliding the reflector assembly out from between the arms of the spring 18 or by removing the spring 18 entirely from the grooves 24 in the posts 20. The bulb can then be easily changed or the assembly 10 replaced and the spring reinstalled. Obviously, no tools are needed to accomplish this change and it can be done very quickly and easily, even when the reflector may be at an elevated temperature. By grasping the base of the bulb 16 or by merely removing the spring and allowing the heated assembly 10 to drop from the fixture 12, a new cool replacement can be quickly installed. The spring 18 in the spread condition will tend to try and contract back to its parallel condition and in so doing, will center the reflector along a line drawn between the axis of the two posts 20. Similarly, the spring acting on the circumference of the reflector will tend to position the bulb and reflector assembly 10 midway between the two posts 20.

It is thus seen that I have provided a very simple, easy to manufacture, economical, vibration resistant apparatus for quickly and easily mounting and dismounting a bulb and reflector assembly to a lamp fixture.

While this invention has been explained with reference to the structure disclosed herein, it is not confined to the details set forth and this application is intended to cover any modifications and changes as may come within the scope of the following claims.

What is claimed is:

1. Mounting means for detachably securing a lamp on an illuminating device comprising an endless spring loop formed into a pair of spaced apart elongated parallel spring arms adapted to be further deformed apart to receive therebetween the lamp to be mounted;

spacer means in the form of a single pair of posts operatively mounted on an illuminating device for positioning said pair of spring arms a predetermined distance from the illuminating device;

said parallel spring arms being mounted on said spacer means;

said spring arms being spaced apart a predetermined distance and spaced from the illuminating device a second predetermined distance so as to cooperatively receive between said arms and between said arms and illuminating device a lamp in operative alignment in said illuminating device.

2. A lamp mounting assembly for supporting a lamp in a fixture which comprises:

a lamp fixture having a generally circular opening therein, for receiving thereon a reflector and bulb assembly so as to project light through said opening, a generally hollow cup shaped reflector, having an apex with a center thereto, a diameter, a circumferential outer edge, a lip, an overall depth, an outer surface and an inner surface, and being adapted to be positioned on said lamp fixture about said opening;

a bulb mounted in the apex center of said reflector;

a single pair of spaced apart posts fixed on said lamp fixture at opposite ends of an extended diameter of said cup shaped reflector, said posts having tops and bottoms, and outer ends;

a closed elongated loop of resilient material disposed about said pair of posts;

said posts having a diameter less than the diameter of said cup shaped reflector and having a length less than the overall depth of said cup shaped reflector;

so that upon installation of said reflector on said lamp fixture, said resilient loop is spread apart and wrapped partly around said reflector to urge said cup shaped reflector into engagement with said fixture and to center said reflector between said posts and about said opening.

3. A lamp mounting assembly according to claim 2 wherein said posts have an annular groove adjacent the tops thereof to receive said resilient material loop.

4. A lamp mounting assembly according to claim 3 wherein said closed elongated loop of resilient material is an endless coil spring.

5. A lamp mounting assembly according to claim 4 wherein said cup shaped reflector has a generally hemispherical outer surface and said coil spring engages about two opposite chordal segments of said surface substantially midway between the lip and apex of said hemispherical reflector.

6. A lamp mounting assembly according to claim 2 including an annular groove formed about said opening in one side of the lamp fixture, sized to receive the circumferential outer edge of said cup shaped reflector to position and hold said reflector in a predetermined position on said fixture.

7. Mounting means for detachably securing a bulb and reflector assembly to a lamp fixture for easy and quick assembly and disassembly which comprises in combination:

a single pair of standoff posts fixed on one side of a lamp fixture;

said standoff posts being spaced apart about a circumference of an area adapted to receive therein a bulb and reflector assembly comprising a bulb mounted in a generally hemispherical hollow cup shaped reflector having an apex with a center thereto, a diameter, a circumferential outer edge, a lip, an overall depth an outer surface and an inner surface.

an endless resilient band disposed about outer ends of said posts so as to overlie at least a portion of the bulb and reflector assembly to be installed therein;

said resilient band being mounted on said standoff posts at a distance from the lamp fixture so as to engage the outer surface of the bulb and reflector assembly when installed thereon, along a line spaced a substantial distance from either extremity of depth of said reflector.

8. A lamp mounting assembly according to claim 7 wherein said standoff posts have an annular groove adjacent the outer end and an overall length less than the overall depth of the reflector to be mounted thereon so as to securely position said band to exert both a centering action and a clamping action on the reflector positioned therein relative to the lamp fixture.

9. A mounting means according to claim 7 wherein said resilient band is positioned about said standoff posts so as to engage the outer surface of the mounted reflector approximately halfway between the lip and apex of the reflector.

10. Lamp mounting means according to claim 7 wherein said plurality of standoff posts is a pair of standoff posts fixed to the lamp fixture substantially at the opposite ends of an extended diameter of the generally hemispherical hollow cup shaped reflector to be mounted on the lamp fixture.

11. Mounting means for a bulb and reflector assembly according to claim 7 wherein said resilient band is an endless coil spring;

said plurality of standoff posts comprise a pair of posts mounted substantially at opposite ends of an extended diameter of the reflector to be mounted thereon; and said posts have a diameter substantially smaller than the diameter of said reflector to be mounted so as to form a pair of parallel spring arm members adapted to be spread apart about a reflector when the bulb and reflector assembly is installed therein to partially wrap around and secure the bulb and reflector assembly to the lamp fixture.

* * * * *